US011406858B2

(12) United States Patent
Villency et al.

(10) Patent No.: US 11,406,858 B2
(45) **Date of Patent: *Aug. 9, 2022**

(54) SYSTEMS AND METHODS FOR PROVIDING VARYING RESISTANCE IN EXERCISE EQUIPMENT THROUGH LOOP DRIVE MECHANISM

(71) Applicant: VR Optics, LLC, New York, NY (US)

(72) Inventors: Eric Villency, New York, NY (US); Matthew Brand, Brooklyn, NY (US)

(73) Assignee: VR Optics, LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/795,367

(22) Filed: Feb. 19, 2020

(65) Prior Publication Data

US 2020/0188720 A1 Jun. 18, 2020

Related U.S. Application Data

(63) Continuation-in-part of application No. 16/228,033, filed on Dec. 20, 2018, now Pat. No. 10,953,282.

(60) Provisional application No. 62/780,798, filed on Dec. 17, 2018.

(51) Int. Cl.
*A63B 21/00* (2006.01)
*A63B 22/00* (2006.01)

(52) U.S. Cl.
CPC ..... *A63B 21/00076* (2013.01); *A63B 21/154* (2013.01); *A63B 22/0087* (2013.01)

(58) Field of Classification Search
CPC .... A63B 21/15–157; A63B 22/20–208; A63B 22/14; A63B 21/00076; A63B 21/154; A63B 22/0087; A63B 21/0058; A63B 21/023; A63B 21/0626; A63B 21/4031; A63B 21/4034; A63B 21/4035; A63B 23/03525; A63B 23/03541; A63B 23/0405; A63B 71/0622; A63B 2071/0625; A63B 24/0087; A63B 2024/0071; A63B 2024/0093; A63B 2071/024; A63B 2071/0675; A63B 2220/20; A63B 2220/24; A63B 2220/51; A63B 2220/802; A63B 2220/808; A63B 2220/833;

(Continued)

(56) References Cited

U.S. PATENT DOCUMENTS 4,765,613 A * 8/1988 Voris ..... A63B 21/0056 482/137
4,900,013 A * 2/1990 Rodgers, Jr. ..... A63B 21/00178 482/6

(Continued)

*Primary Examiner* — Nyca T Nguyen
(74) *Attorney, Agent, or Firm* — BakerHostetler

(57) ABSTRACT

A system for providing resistance in an exercise machine. The system includes a motor, at least one loop drive attached to the motor. A carriage is coupled to the loop drive. The carriage moves in a first direction when the motor is turned in a first direction and a second direction when the motor is turned in a second direction. At least one sensor is attached to the carriage, wherein the at least one sensor is configured to detect external force on the carriage. Information from the sensor indicates external force on the carriage. The information is used to determine a movement of the carriage in response to the external force. The motor is instructed to turn the loop drive to apply the movement.

13 Claims, 6 Drawing Sheets

(58) Field of Classification Search
CPC ..... A63B 2225/10; A63B 2225/20; A63B 2225/50; A63B 2230/01
See application file for complete search history.

(56) References Cited

U.S. PATENT DOCUMENTS 4,907,797 A * 3/1990 Gezari ..... A63B 21/0058 482/135
4,979,733 A * 12/1990 Prud'Hon ..... A63B 21/0058 482/4
5,314,390 A * 5/1994 Westing ..... A63B 21/00178 482/111
5,569,121 A * 10/1996 Sellier ..... A63B 21/0058 318/806
6,261,205 B1 * 7/2001 Elefson ..... A63B 21/00181 482/135
6,293,892 B1 * 9/2001 Slawinski ..... A63B 21/00181 482/104
6,299,566 B1 * 10/2001 Wu ..... A61H 1/0255 482/52
6,626,802 B1 * 9/2003 Rodgers, Jr. ..... A63B 21/00181 482/110
7,125,370 B1 * 10/2006 Schaffner ..... A63B 21/155 482/142
7,785,232 B2 * 8/2010 Cole ..... A63B 24/00 482/5
8,025,608 B2 * 9/2011 Popescu ..... A63B 21/4043 482/37
8,858,397 B2 * 10/2014 Ishii ..... A63B 24/0087 482/6
9,108,080 B2 * 8/2015 Cataldi ..... A63B 21/4045
2004/0127821 A1 * 7/2004 Ou ..... A61H 1/0277 601/5
2005/0164853 A1 * 7/2005 Naidus ..... A63B 21/4047 482/100
2010/0041520 A1 * 2/2010 Popescu ..... A63B 23/03525 482/37
2010/0331144 A1 * 12/2010 Rindfleisch ..... A63B 21/00178 482/4
2011/0166002 A1 * 7/2011 Savsek ..... A63B 24/00 482/121
2011/0208098 A1 * 8/2011 Zaborowski ..... A61H 1/0274 601/33
2012/0184409 A1 * 7/2012 Beal ..... A63B 23/1209 482/5
2014/0038777 A1 * 2/2014 Bird ..... A63B 21/151 482/5
2014/0087922 A1 * 3/2014 Bayerlein ..... A63B 21/00181 482/54
2014/0094721 A1 * 4/2014 Diallo ..... A63B 21/0058 601/5
2016/0059060 A1 * 3/2016 Lagree ..... A63B 21/023 482/129
2017/0100586 A1 * 4/2017 Akiba ..... A61N 1/36034
2017/0340502 A1 * 11/2017 Roh ..... A61H 1/008
2018/0071159 A1 * 3/2018 Glukhovsky ..... A63B 69/0064
2018/0326241 A1 * 11/2018 Huskins ..... A63B 23/0417
2019/0099632 A1 * 4/2019 Orady ..... A63B 21/156

* cited by examiner

SYSTEMS AND METHODS FOR PROVIDING VARYING RESISTANCE IN EXERCISE EQUIPMENT THROUGH LOOP DRIVE MECHANISM

CROSS-REFERENCE TO RELATED APPLICATION

This patent application is a continuation in part of U.S. patent application Ser. No. 16/228,033, filed Dec. 20, 2018, which claims the benefit of provisional patent application 62/780,798 filed Dec. 17, 2018, both of which are incorporated herein by reference in their entirety.

TECHNICAL FIELD

This disclosure relates generally to exercise equipment and more particularly to systems and methods for providing resistance in exercise equipment.

BACKGROUND

Resistance training is a core element to strength and conditioning programs. Resistance training involves a person performing a movement, while one or more muscles are under a load. The load is generally referred to as resistance. Common exercises include squats, presses, pulls or rows, and curls. In addition, there are exercise methodologies, like Pilates, which utilize aspects of resistance training within a broader context of whole body fitness goals, such as improved flexibility, balance, and endurance. Regardless of the exercise, performing resistance training requires some way of providing a load as a person is performing a movement.

In a system like Pilates, a device referred to a "reformer" is used. A reformer is a device having one or more rails upon which a carriage moves. The carriage is attached to one or more springs that resist the movement of the carriage along the rails. Users position themselves in various ways on the carriage and move the carriage, thereby expanding, contracting, and stretching various muscles. The resistance can be changed by changing the spring that is used to resist the movement.

One problem associated with existing reformers it is not possible to change resistive loads during a movement. A user has to stop a movement and change the spring to increase or decrease the load. Also, since it is not possible to provide an infinite number of springs in a reformer, the reformer is limited in the number of options that it can provide for resistance. That is, the springs used in reformers provide discrete rather than continuous resistance amounts. Each spring represents a resistance amount, but the resistance amounts in between the values of each spring are not provided in existing reformers.

A similar problem exists with respect to exercise machines, such as leg press machines or universal resistance machines. It is not possible to change loads during a movement. Further, it is inefficient to change plates in between movements, such as when multiple users are working out or when a single user wants to change a load during a set.

Accordingly, what is needed, as set forth in the present disclosure, are systems and methods for providing resistance in exercise equipment through utilization of a loop drive mechanism.

SUMMARY

In one embodiment, a system is provided. System includes a motor, at least one loop drive attached to the motor. The motor has an axis of rotation and is configured such that the motor can turn the loop drive in a first direction and a second direction around the axis of rotation. A carriage is coupled to the loop drive. The carriage moves in a first direction relative to motor when the motor is turned in a first direction and a second direction relative to the motor when the loop drive is turned in a second direction. At least one sensor is attached to the carriage, wherein the at least one sensor is configured to detect external force on the carriage. A processor and a memory coupled with the processor are included in the system. The memory comprises executable instructions that when executed by the processor cause the processor to effectuate operations. The operations include receiving information from the sensor indicative of the external force on the carriage. Utilizing the information to determine a movement of the carriage in response to the external force and instructing the motor to turn the loop drive to apply the movement.

BRIEF DESCRIPTION OF THE DRAWINGS

In the following description, for purposes of explanation, numerous specific details are set forth in order to provide an understanding of the variations in implementing the disclosed technology. However, the instant disclosure may take many different forms and should not be construed as limited to the examples set forth herein. Where practical, like numbers refer to like elements throughout.

DETAILED DESCRIPTION

Figure 1A:
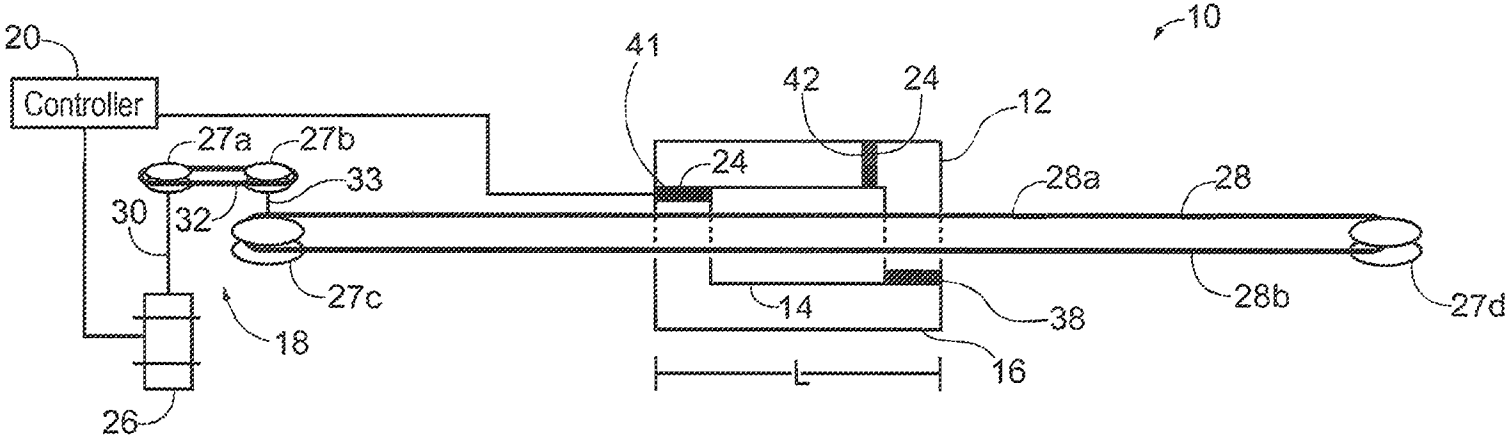
FIG. 1A and FIG. 1B are functional block representations of exemplary systems for providing varying resistance in exercise equipment.

FIG. 1A is a representative system 10 for providing varying resistance in exercise equipment. In one embodiment, system 10 comprises carriage 12, having an inner structure 14 and an outer structure 16, a loop drive 18, a controller 20, and one or more sensors 24.

In one example, inner structure 14 and outer structure 16 may each comprise a plate, frame, and/or another type of body that are moveable with respect to each other. For instance, inner structure 14 and outer structure 16 may be moveably attached to each other such that they move laterally with respect to each along the line identified as L. More detailed exemplary embodiments of inner structure 14 and outer structure 16 will be further provided herein. However, for the purposes of FIG. 1, it is sufficient to recognize that they move laterally with respect to each other along the line L. It should be also understood that inner structure 14 and outer structure 16 may also move in other directions with respect to each other without departing from the scope of the disclosure.

Referring further to FIG. 1A, loop drive 18 comprises a motor 26, at least one rotating element 27, and at least one loop element 28. Motor 26 turns a shaft 30 which is connected to rotating element 27*a*. rotating element 27*a* is connected to rotating element 27*b* by loop element 32. Rotating element 27*b* is connected to rotating element 27*c* through shaft 33. Rotating element 27*c* is connected to rotating element 27*d* by loop element 28. Accordingly, as motor turns shaft 30 clockwise, the rotational movement causes rotating element 27*a* to turn clockwise, which then causes loop element 32 to turn rotating element 27*b* clockwise. The rotational movement of rotating element 27*b* is translated along shaft 33, which causes rotating element 27*c* to turn clockwise. This clockwise movement of rotating element 27*c* causes loop element 28 to move in a first direction along line L. When motor 26 turns shaft 30 counterclockwise, the opposite effect occurs and rotating elements 27*a*, 27*b*, 27*c*, 27*d* move counterclockwise and thus move loop element in a second direction, which is opposite the first direction, along line L.

Referring further to FIG. 1A, loop drive 18 may take different forms depending on the use case for system 10 and should not be limited to the embodiments disclosed herein for illustrative purposes. Loop drive 18 in its generic form is a mechanism for transferring rotary motion between two shafts. By translating rotational movement between shafts, carriage 12 is moved along line L. In one embodiment, loop drive 18 may be a chain drive. In such and embodiment, rotating elements 27*a*, 27*b*, 27*c*, 27*d* would be gears and loop elements 28, 33 would be chains. In one embodiment, loop drive 18 may be a belt drive. In such an embodiment, rotating elements 27*a*, 27*b*, 27*c*, 27*d* may be pulleys and loop elements 28, 33 may be belts. Structures and materials other than belt drives and chain drives are also envisioned. Further, it should be understood that loop dive 18 may include additional belts, rotating elements, and configurations without departing from the scope of this disclosure.

Referring further to FIG. 1A, loop element 28 as it is oriented around rotating elements 27*c*, 27*d* forms a loop having a top portion 28*a* and a bottom portion 28*b* that are spaced apart. In one embodiment, bottom portion 28*b* of loop element 28 is connected to inner structure 14 of carriage 12. Therefore, as loop element 18 move along line L, it will exert a force on inner structure 14 and move it along line L. Therefore, if motor 26 turns shaft 30 clockwise, loop element 28 will exert a force on inner structure 14 and move it toward rotating element 27*d*. Conversely, if motor 26 turns shaft counterclockwise, loop element 28 will move inner structure toward rotating element 27*c*. In addition, it should be understood that when motor 26 does not turn shaft 30, inner structure 14 is substantially fixed in place along line L.

Referring further to FIG. 1A, outer structure 16 in one example is not connected to loop element 28. In one example, outer structure 16 is positioned in a different plane than loop element 28. Therefore, outer structure 16 floats substantially above or below the plane of loop element 28 depending on the orientation from which one views carriage 12. Because, loop element 28 is not connected to outer structure 16 and outer structure 16 is on a different plane than loop element 28, movement of loop element 28 does not directly impart movement to outer structure 16. Nevertheless, in one example, at least one connecting device 38 connects inner structure 14 to outer structure 16. Such a connecting device 38 could take many including, but not limited to, flexible and expandable materials, such as springs, rubber, foam, and combinations thereof. Such materials may be used in connection with other materials, such as bolts, brackets, shims, rails, tracks, etc. to connect inner structure 14 and outer structure 16 together in a moveable manner. The connection of inner structure 14 and outer structure 16 allows motor 26 to impart movement to outer structure 16 by moving loop element 28 and thereby by moving inner structure 14 to impart a force on outer structure 16 through connecting devices 38. It should be noted that a single connecting device 38 is shown in FIG. 1 for illustrative purpose, but multiple connecting devices 38 may be used. For instance, a connecting device 38 may reside at each corner of inner structure 14.

Referring further to FIG. 1A, because outer structure 16 is not connected to loop element 28 and is outside the plane of loop element 28, outer structure 16 does not require loop element 18 to move. Accordingly, outer structure 16 may be actuated by another device or actor. For instance, a mechanical actuator, such as a bar, a pulley system, a handle, a cable, and or a lever, etc. may be attached to outer structure 16 and allow a user to actuate movement of outer structure 16 relative to inner structure 14, which is held in place by loop element 28. This allows a user to provide force, such as in a weightlifting or Pilates movement, indirectly against inner structure 14.

Referring further to FIG. 1A, loop element 28 extends along and beyond a length of carriage 12. In one embodiment, rotating elements 27*c*, 27*d* and loop element 28 may be enclosed within a housing of a machine (not shown). Motor 26 turns shaft 30, and the ensuing movement of loop element 28 causes inner structure 14 to move relative along line L. Accordingly, motor 26 may be used to provide force on carriage 12 along the direction of line L by turning shaft 30. Such force may be varied in direction by the direction of rotation of shaft 30 and varied in magnitude by the torque at which motor 26 operates.

Referring further to FIG. 1A, controller 20 and sensors 24 in one example are utilized to measure the force exerted between inner structure 14 and outer structure 16. In one example, a first sensor 41 may be a slide potentiometer that measures the displacement of inner structure 14 and outer structure 16. A second sensor 42 may be an angle potentiometer. An angle potentiometer may be used to measure an angle of an external structure relative to outer structure 16. For instance, a lever may be attached to outer structure 16 and an angle potentiometer may be used to measure the angle of the lever relative to outer structure 16, as will be discussed in more detail herein. It should be noted that two sensors 24 are depicted for illustrative purposes, but more sensors 24 may be used and in different configurations. Sensors 24 measure the direction and magnitude of force exerted by inner structure 14 on outer structure 16 and provide such measurements to controller 20, which operates motor 26 in accordance with one or more algorithms and/or routines with which controller 20 is programmed.

Referring further to FIG. 1A, in one example, controller 20 may be programmed to instruct motor 26 to move loop element 28 in a first direction when a certain force is imparted by outer structure 16 on inner structure. For instance, a user may perform a movement in which the user provides force against outer structure 16, which causes outer structure 16 to move relative to inner structure 14. Sensors 24 will report such force to controller 20 and controller 20 may be programmed to either allow such force at a certain magnitude (in the case of a positive portion of an exercise movement) or to resist such movement and drive carriage 12 in the opposite direction and at a certain magnitude (in the case of negative movement). In another example, system 10 may be in an operating mode in which controller 20 allows carriage 12 to move freely. For example, such a mode may be to allow user to move carriage 12 to a desired position. In such a mode, the slightest force exerted on inner structure 14 by outer structure 16 may cause controller 20 to rotate motor 26 so that carriage 12 moves rapidly to the desired position. In another example, a user may want to perform an isometric exercise. An operating mode may be programmed such that controller 20 does not move carriage 12 regardless of the force exerted by outer structure 16 against inner structure 14.

Because motor 26 and controller 20 can selectively rotate shaft 30 to move carriage 12 along line L, system 10 may be utilized in exercise equipment to provide variable resistance while users perform certain movements. The programming of controller 20 may be customized according to the objectives of the individual users, manufacturers, and/or personal trainers. An exemplary device that may be utilized as controller 20 is discussed in connection with FIG. 4. It should be noted that controller 20 may include an input/output device that would allow a user to program system 10 and/or select an operating mode for system 10. Therefore, while exercising a user could select an exercise program, increase resistance, and decrease resistance as needed. A user's selections would be effectuated by controller 20 tailoring the direction of movement and/or torque of motor 26 to provide the resistance desired by the user. Furthermore, such resistance can be varied over time by varying the torque and/or direction of the motor 20.

Figure 1B:
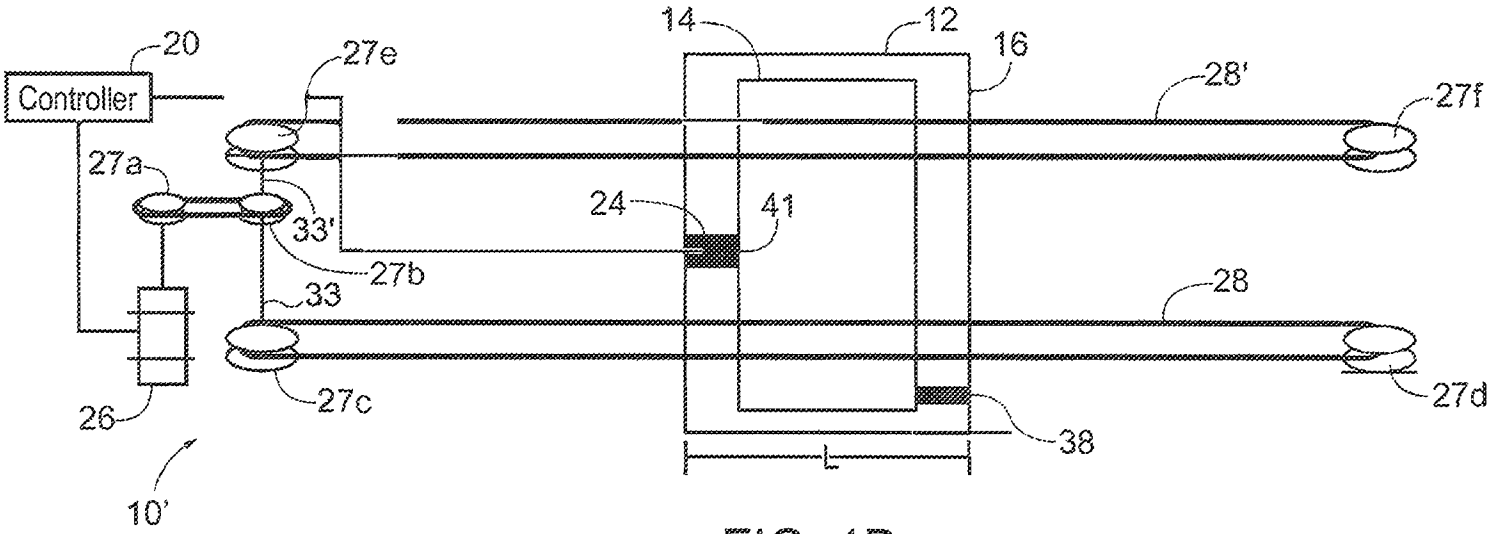

Referring to FIG. 1B, another embodiment of system 10' is shown for exemplary purposes. FIG. 1B depicts an embodiment in which there are two loop elements 28, 28' rather than the one loop element 28 shown in FIG. 1A. The use of two loop elements 28, 28' may be advantageous in certain exercise applications. For example, the system 10 of FIG. 1A may be utilized in a resistance machine, such as squat, press, or leg extension machine in which one loop element 28 may be sufficient to accomplish its purpose. In the example shown in FIG. 1B, system 10' may be utilized in an application, such as a Pilates reformer. The use of two loop elements 28, 28' may allow for a carriage 12 to have larger surface area such that a platform could be attached to carriage 12. It should be noted that the preceding examples are provided for illustrative purposes and not to limit the use of systems 10, 10' to particular use cases, equipment, or configurations. To implement the configuration of system 10', rotating element 27*b* includes a second shaft 33'. The second shaft is attached to rotating element 27*e*, which is connected to rotating element 27*f*, by loop element 28'.

In addition, the configurations shown in FIGS. 1A and 1B are also illustrative. It is envisioned that systems 10, 10' may include multiple carriages 12, motors 20, and controllers 22 without departing from the scope of the disclosure. An example of using system 10 with multiple motors 20 and/or controllers would be a multifunction exercise apparatus. One carriage 12, loop drive 18, and controller 20 could govern all functions or multiple carriages 12, loop drives 18, and controllers 20 could be used, such that each function would have dedicated hardware. Another example, would be to configure system 10 with multiple loop drives 18, which would each be driven by a dedicated motor 26. As an example, such a configuration may be worthwhile to provide higher levels of resistance since two motors 26 could perform more work than one motor 26.

Figure 2:
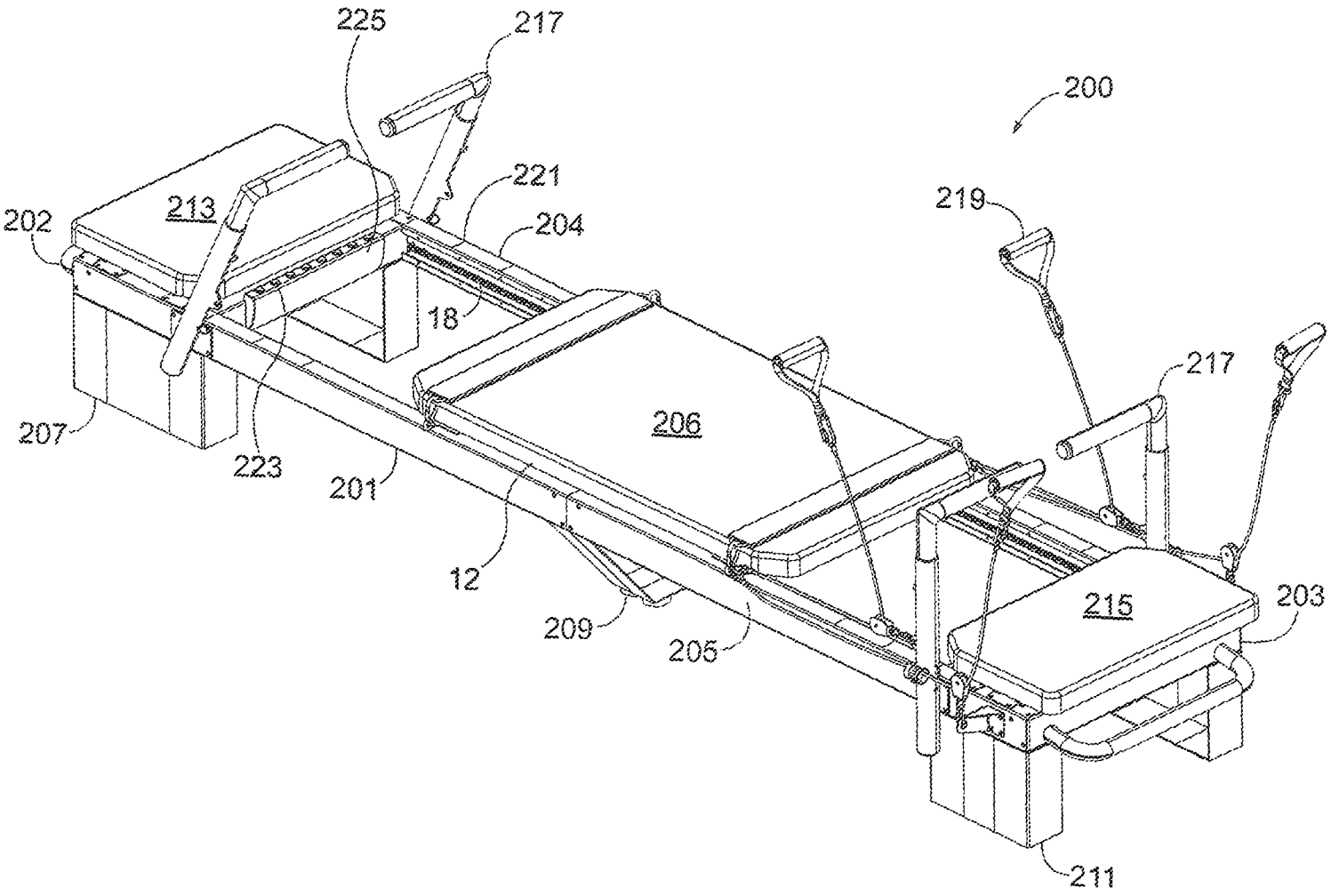
FIG. 2 is a perspective view of an exemplary reformer using the system of FIG. 1B.

Referring to FIG. 2, an illustrative embodiment of a Pilates reformer 200 using the system configuration 10' of FIG. 1B is now provided for illustrative purposes. Reformer 200 includes a housing 201 including a first end 202 and a second end 203. Housing 201 includes two spaced apart rails 204, 205 upon which carriage 12 is mounted. Carriage 12 is operable to move longitudinally between first end 202 and second end 203. Carriage 12 includes a surface 206 upon which users may position themselves. Housing 201 in one example includes a first support member 207 positioned at first end 202, a second support member 209 positioned between first end 202 and second end 203, and a third support member 211 positioned at second end 203. The support members 207, 209, 211 allow support rails 204, 205 to be elevated above the surface upon which reformer 200 rests. A surface 213 may be positioned above support member 207 which allows users to rest their heads or feet when the reformer is in use. Another surface 215 may be located at the second end 203 above support member 211. Handles 217 are positioned first end 202 and second end 203. Handles 217 allow users to push and/or pull themselves toward first end 202 or second end 203. A pulley system 219 in one examples is provided for users to pull themselves toward second end 203. Alternatively, a pulley system (not shown) could be provided to allow users to pull themselves toward first end 202.

Figure 3A:
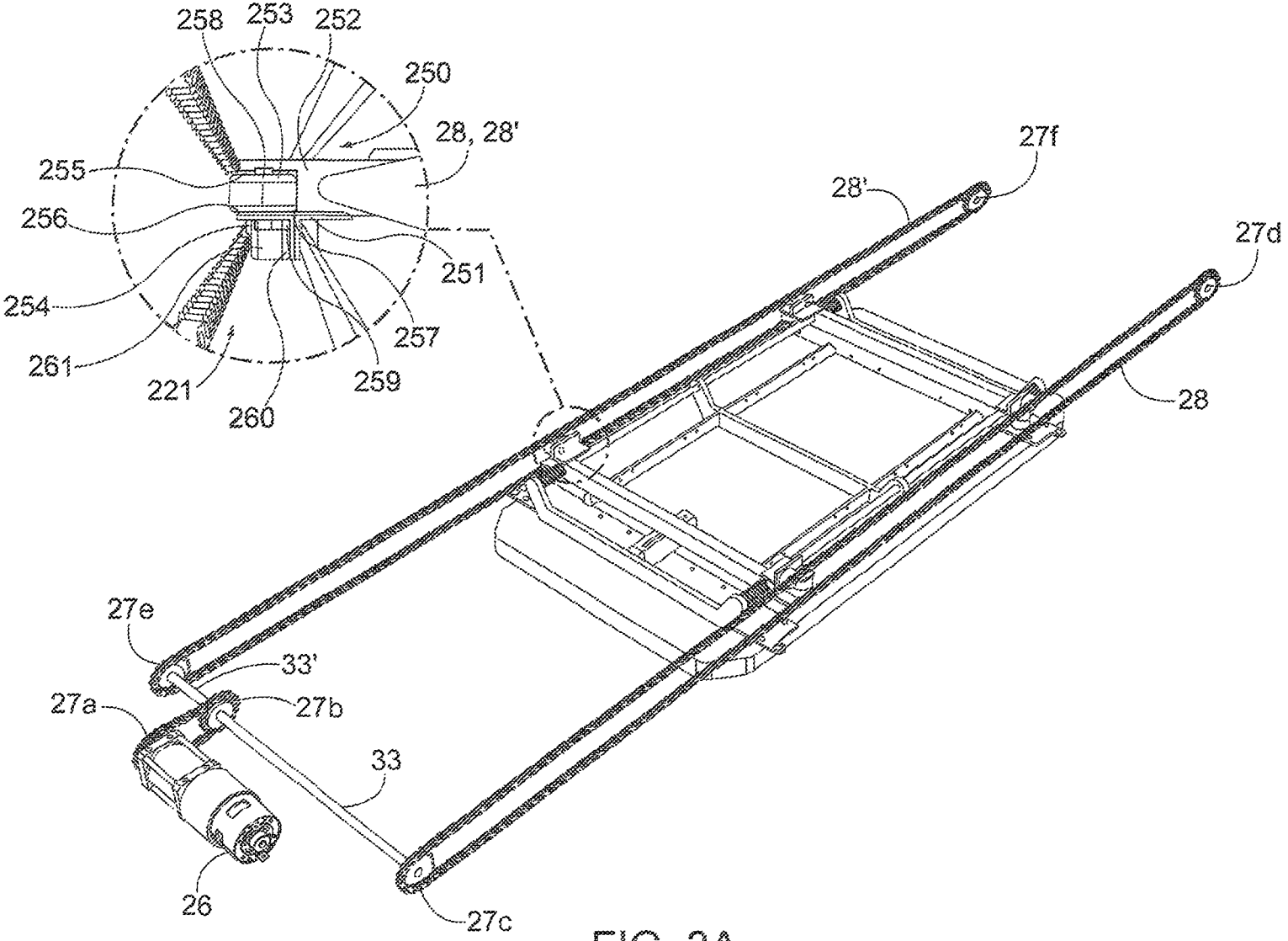
FIG. 3A is a perspective view taken from beneath a carriage and loop drive that may be used in the reformer of and an enlarged view of a connector used to connect the carriage to the loop drive is also shown (taken from the front or rear perspective of the reformer).

Referring now to FIG. 2 and FIG. 3A, support rails 204, 205 in one example each have a channel 221. Channels 221 define a space in which loop elements 28, 28' (for illustrative purposes shown as chains) and rotating elements 27*c*, 27*d*, 27*e*, 27*f* (for illustrative purposes shown as gears) may be positioned. Motor 26 and controller 20 (both not shown) may be mounted to housing 201. For example, a motor 26 and controller 20 may be mounted in the space defined by first support member 207, surface 213, and the surface upon which reformer 200 rests. A controller 20 may be connected to a user interface 223 which allows a user to program controller 20 to provide a certain resistance or run a resistance routine. In one embodiment user interface 223 comprises a line of color coded buttons 225. Each button may instruct controller 20 to operate to provide a certain level of resistance. If no button is actuated, controller 20 may operate to provide minimal resistance. For instance, controller 20 may operate to instruct motor 26 to move carriage 12 in whatever direction the user pushes or pulls. In another embodiment, interface 223 may be a device that provides users with a graphical user interface, such as a touchscreen, to provide program controller 20. In another embodiment, user interface 223 may be provided through a device, such as a smartphone that is connected to controller through a wireless or wired interface.

Referring to FIG. 3A, an exemplary embodiment, of a connector 250 for connecting loop elements 28, 28' to carriage 12 is now shown for illustrative purposes. The connector 250 in one example includes a T-shaped bracket portion 251 and a support member 252. The support member has a U-shaped cutout 253 formed by a side surface 255, an opposing side surface 256, and a bottom surface 257. A wheel 258 is rotatably connected to the connector 250 in between side surface 255 and opposing side surface 256. An L shaped cutout 259 is formed by side surface 256 and perpendicular surface 260. Another wheel 261 is rotatably attached to perpendicular surface 260. The axis of rotation of wheel 258 and wheel 261 are perpendicular to each other. Loop elements 28, 28' may be connected to the other side of surface 260. In one example, loop elements 28, 28' may be connected by forming a hole in support member 252 and press fitting loop elements 28, 28' within such holes. In another embodiment, loop elements 28, 28' may be welded to support member 252. In another embodiment, loop elements 28, 28' may be connected to support member 252 with an appropriate fastener, such as a screw, nut, or bolt. Connector 250 may be formed as an integral part of inner structure 14 or may be connected to inner structure through welding or a fastener.

Referring further to FIG. 2B, as motor 26 exerts force on loop elements 28, 28', loop elements 28, 28' will exert force on connectors 250, which will then cause carriage to move. Wheels 258, 261 guide loop elements 28, 28' and allow carriage 16 to move smoothly within channels 221.

Figure 3B:
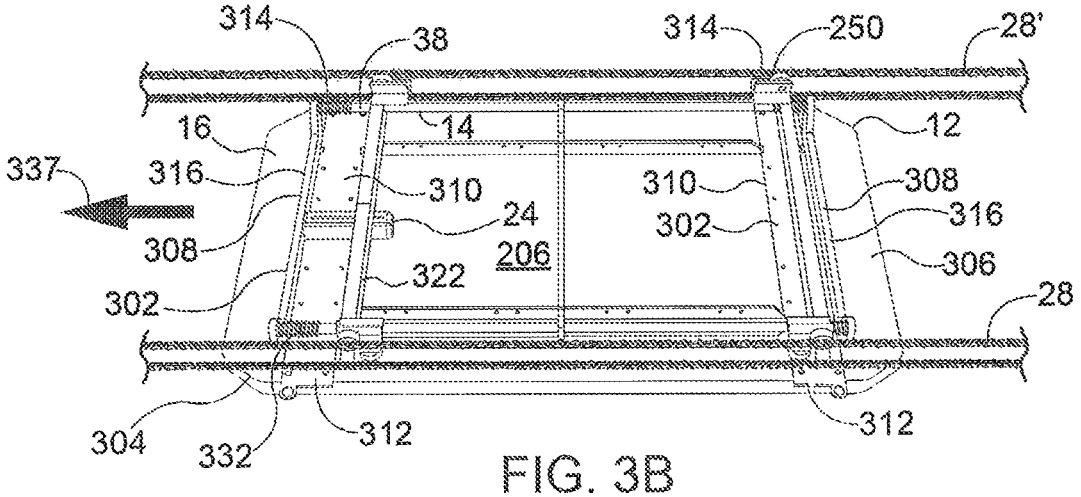
FIG. 3B, FIG. 3C and FIG. 3D are bottom views of the carriage and loop drive of FIG. 3A showing movement of the carriage in response to rotation of the screw mechanism.
Figure 3C:
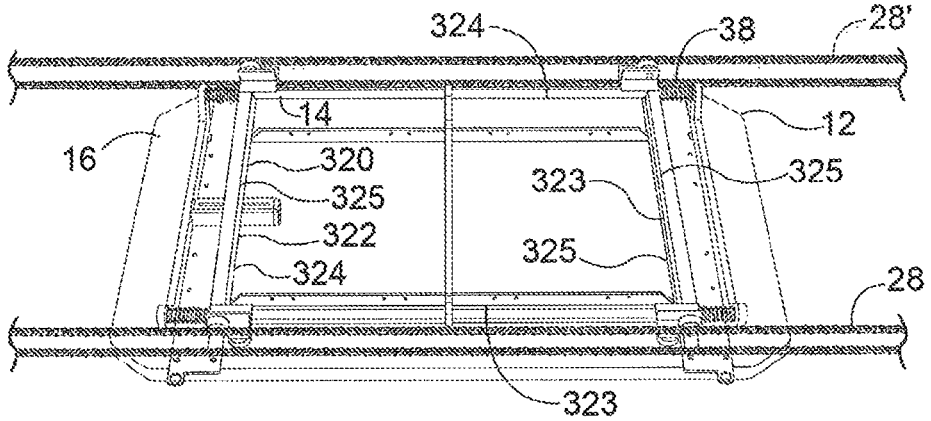
Figure 3D:
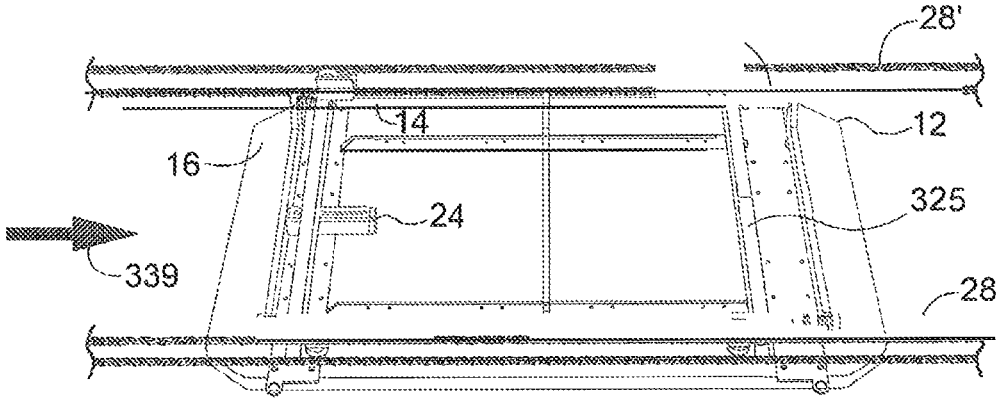

Referring to FIG. 3B-3D, another partial view of the bottom side of carriage 12 is shown for illustrative purposes. Carriage 12 is connected to loop elements 28, 28' through the use of connectors 250 that are positioned at least one corner of inner structure 14. Loop elements 28, 28' are driven by motor 26 as described in connection with FIG. 1A and FIG. 1B. Outer structure 16 comprises surface 206 with anchor plates 302 attached thereto. Referring to FIG. 3B, there is an anchor plate 302 at first end 304 of outer structure 16 and an anchor plate 302 at the second end 306 of outer structure 16. The anchor plates 302 in one example are bolted or screwed to surface 206, which may be a plate made of suitable material, such as wood or metal. The anchor plates 302 in one example include a first end 308, opposing second end 310, a side 312, and an opposing side 314. A ridge 316 is positioned on the first side 308 and extends between the first end 306 and the second end 308. The ridge 316 in one example is attached to inner structure 14. In one example, ridge 316 is attached to inner structure 14 through four connecting devices 38 positioned at respective corners of inner structure 14 and outer structure 16. In one example, connecting devices 38 comprise a metal rod with a spring 332, or other compressible/stretchable material, positioned axially thereon. The metal rod in one example may be fixed to ridge 316 such that it does not move relative to ridge 316.

Referring further to FIG. 3C, inner structure 14 in one example comprises frame 320. Frame 320 includes first end 322 and opposing second end 323. A first side 323 and opposing second side 324 extend between first end 322 and second end 323. Ridges 325 are positioned on first end 322 and second end 323 extending between first side 323 and second side 324. Ridges 325 opposes ridges 316 of outer structure 16. Ridges 325 are attached to ridge 316 of outer structure 16. In one example, ridges 316 are attached to ridges 316 by providing a corresponding opening on ridge 325 and positioning a rod from connecting device 38 in the opening. Ridges 325 may be made moveable with respect to rod by making the opening larger than rod. A fastener may be positioned on rod to prevent inner structure 14 and outer structure 16 from separating. The spring 332 allows outer structure 16 and inner structure 14 to move relative to each other without coming in contact. The spring 332 also biases outer structure 16 away from inner structure to create a steady state position. A corresponding structure is positioned on the other end 32 of inner structure 14 and the other end 36 of outer structure 16.

Referring to FIG. 3B, as loop elements 28, 28' move in a first direction 337, inner structure 14 at end 322 moves toward outer structure 16 at end 304. When connectors 38 reach a certain point of compression inner structure 14 will move outer structure 16 in a first direction 337. Referring to FIG. 3D, conversely, when loop elements 28, 28' move in a second direction 339, inner structure 14 will move in a second direction 339 opposite to the first direction. Ridge 325 at second end 323 of inner structure 14 will bear against outer structure ridge 316 at end 306 of outer structure 16 through connectors 38 in a second direction 339, which is opposite the first direction. It should be noted that when the movements described in FIGS. 3B and 3D occur, equal but opposite reactions occurs on the opposing ends of inner structure 14 and outer structure 16. Sensor 24 detects the displacement of inner structure 14 and outer structure 16 relative to each other and provides the displacement value to controller 20.

Referring to FIGS. 6-18, additional embodiments of exercise machines utilizing the systems of FIGS. 1A and 1B are shown for illustrative purposes. FIGS. 6-12 depict a leg press machine. FIGS. 13-18 depict a "universal" style weight machines that utilizes two pulleys, one for each arm or leg. By using two drive belts, the machine in FIGS. 13-18 can isolate each arm and leg and allow them to be trained separately.

Figure 4:
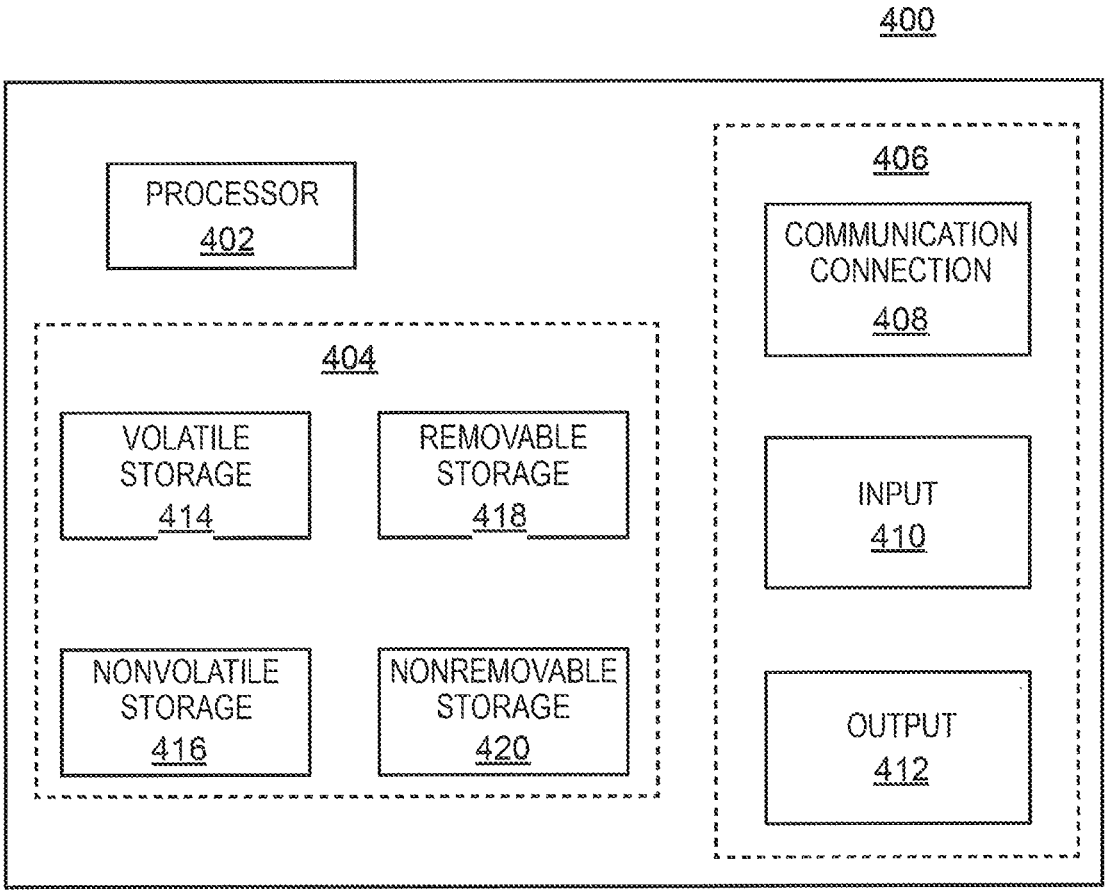
FIG. 4 is an exemplary block diagram depicting a computing device that may be used as a controller in the system of FIG. 1A and FIG. 1B.

Referring to FIG. 4, it should be noted that controller 20 may be implemented on a computing device, an example of which is illustrated in FIG. 4 as a functional block diagram. Computing device 400 may comprise a processor 402 and a memory 404 coupled to processor 402. Memory 404 may contain executable instructions that, when executed by processor 402, cause processor 402 to effectuate operations associated with translating parallel protocols between end points in families as described above. As evident from the description herein, network device 400 is not to be construed as software per se.

In addition to processor 402 and memory 404, computing device 400 may include an input/output system 406. Processor 402, memory 404, and input/output system 406 may be coupled together to allow communications between them. Each portion of computing device 700 may comprise circuitry for performing functions associated with each respective portion. Thus, each portion may comprise hardware, or a combination of hardware and software. Accordingly, each portion of computing device 400 is not to be construed as software per se. Input/output system 406 may be capable of receiving or providing information from or to a communications device or other network entities configured for telecommunications. For example, input/output system 406 may include a wireless communications (e.g., 3G/4G/GPS) card. Input/output system 406 may be capable of receiving or sending video information, audio information, control information, image information, data, or any combination thereof. Input/output system 406 may be capable of transferring information with network device 400. In various configurations, input/output system 406 may receive or provide information via any appropriate means, such as, for example, optical means (e.g., infrared), electromagnetic means (e.g., RF, Wi-Fi, Bluetooth®, ZigBee®), acoustic means (e.g., speaker, microphone, ultrasonic receiver, ultrasonic transmitter), electrical means, or a combination thereof. Bluetooth, infrared, NFC, and Zigbee are generally considered short range (e.g., few centimeters to 20 meters). WiFi is considered medium range (e.g., approximately 100 meters).

Input/output system 406 may contain a communication connection 408 that allows computing device 400 to communicate with other devices, network entities, or the like. Communication connection 408 may comprise communication media. Communication media typically embody computer-readable instructions, data structures, program modules or other data in a modulated data signal such as a carrier wave or other transport mechanism and includes any information delivery media. By way of example, and not limitation, communication media may include wired media such as a wired network or direct-wired connection, or wireless media such as acoustic, RF, infrared, or other wireless media. The term computer-readable media as used herein includes both storage media and communication media. Input/output system 406 also may include an input device 410 such as keyboard, mouse, pen, voice input device, or touch input device. Input/output system 406 may also include an output device 412, such as a display, speakers, or a printer. It should be understood that the various user interfaces described in connection with FIGS. 1A-6 may be implemented as an integrated part of input/output system 406. User interfaces may also be implemented as standalone devices 400 that are interfaced with computing device 400 through input/output system 406.

Processor 402 may be capable of performing functions associated with to control system 10. For example, processor may operate system 10 to provide varying resistance in the machines described in FIGS. 2-6. Processor 402 may be programmed to provide resistance in accordance with a program defined by a user. A user may comprise a user of exercise equipment, a manufacturer of exercise equipment, or a third party, such as a coach or trainer.

Memory 404 of computing device 400 may comprise a storage medium having a concrete, tangible, physical structure. As is known, a signal does not have a concrete, tangible, physical structure. Memory 404, as well as any computer-readable storage medium described herein, is not to be construed as a signal. Memory 404, as well as any computer-readable storage medium described herein, is not to be construed as a transient signal. Memory 404, as well as any computer-readable storage medium described herein, is not to be construed as a propagating signal. Memory 404, as well as any computer-readable storage medium described herein, is to be construed as an article of manufacture.

Memory 404 may store any information utilized in conjunction with operating the system 10 and the exercise equipment shown in the figures as well as variations thereof. Depending upon the exact configuration or type of processor 402, memory 404 may include a volatile storage 414 (such as some types of RAM), a nonvolatile storage 416 (such as ROM, flash memory), or a combination thereof. Memory 404 may include additional storage (e.g., a removable storage 418 or a non-removable storage 420) including, for example, tape, flash memory, smart cards, CD-ROM, DVD, or other optical storage, magnetic cassettes, magnetic tape, magnetic disk storage or other magnetic storage devices, USB-compatible memory, or any other medium that can be used to store information and that can be accessed by computing device 400. Memory 404 may comprise executable instructions that, when executed by processor 402, cause processor 402 to provide varying resistance in an exercise machine.

While examples of systems and methods for providing varying resistance have been described in connection with various machines, computing devices/processors, the underlying concepts may be applied to various equipment that have not been described, but which are within the scope of this disclosure. The various resistance programs described herein may be implemented in controller 20 with hardware or software or, where appropriate, with a combination of both. Thus, controller 20 may take the form of program code (i.e., instructions) embodied in concrete, tangible, storage media having a concrete, tangible, physical structure. Examples of tangible storage media include floppy diskettes, CD-ROMs, DVDs, hard drives, or any other tangible machine-readable storage medium (computer-readable storage medium). Thus, a computer-readable storage medium is not a signal. A computer-readable storage medium is not a transient signal. Further, a computer-readable storage medium is not a propagating signal. A computer-readable storage medium as described herein is an article of manufacture. When the program code is loaded into and executed by a machine, such as a computer, the machine becomes a device for providing varying resistance. In the case of program code execution on programmable computers, the computing device will generally include a processor, a storage medium readable by the processor (including volatile or nonvolatile memory or storage elements), at least one input device, and at least one output device. The program(s) can be implemented in assembly or machine language, if desired. The language can be a compiled or interpreted language and may be combined with hardware implementations.

The methods and devices associated controller 20 may be practiced via communications embodied in the form of program code that is transmitted over some transmission medium, such as over electrical wiring or cabling, through fiber optics, or via any other form of transmission, wherein, when the program code is received and loaded into and executed by a machine, such as an EPROM, a gate array, a programmable logic device (PLD), a client computer, or the like, the machine becomes an device for implementing telecommunications as described herein. When implemented on a general-purpose processor, the program code combines with the processor to provide a unique device that operates to invoke the functionality of controller 20.

Figure 5:
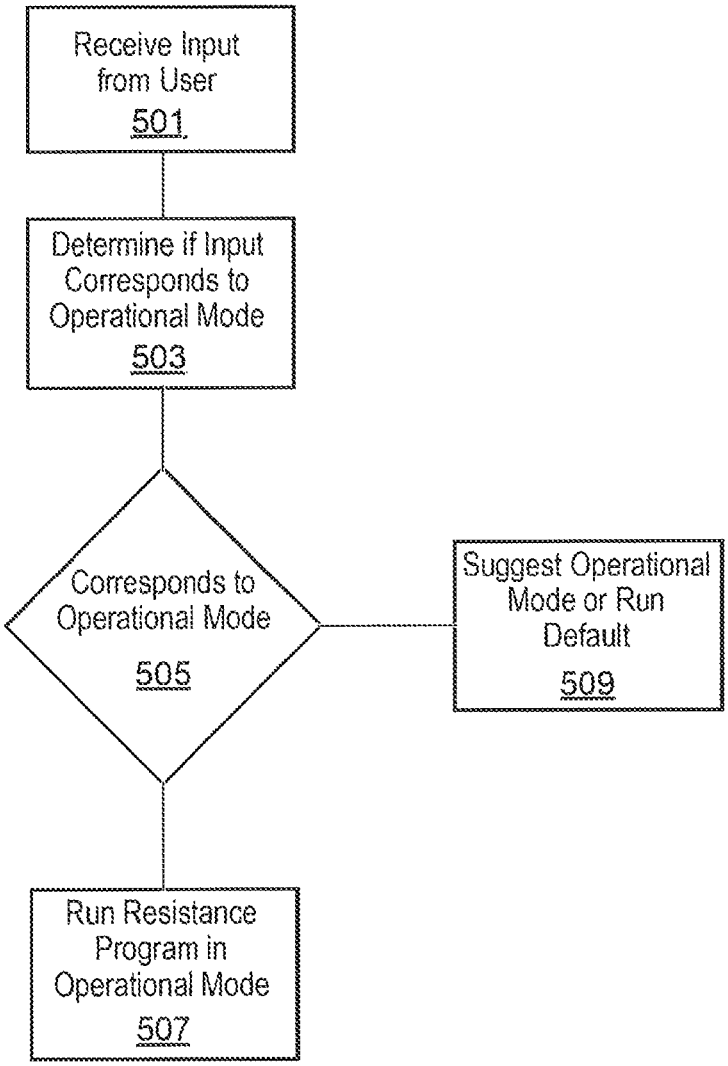
FIG. 5 is a flowchart depicting illustrative operation of the systems.

Referring to FIG. 5, an exemplary method 500 for operating system 10 is now described for illustrative purposes. In step 501, user input is received. User input in one example may be provided through input output system 506 described in connection with FIG. 4. User input may include a number of characteristics of user. For example, user input may include the height and weight of a user. User input may include data indicative of a user's strength. For instance, if a user is capable of performing certain movement with certain amounts of resistance. User input may include one or more exercise modes that that the user would like to perform. For instance, a user may specific that the user would like to operate an exercise machine at a particular varying resistance. One example would be that the user would like to perform a selected movement at a certain resistance during the positive portion of the movement and a resistance equal to 120% of that resistance during the negative portion of the movement. Another example would be that the user would like to perform the a movement at certain resistance at the beginning of a positive portion of a movement and would like the resistance to increase as the user is performing the positive portion of the movement. In another example, the user may indicate that the user would like resistance to vary during the range of a negative portion of a movement. In another example, a user may specify that the user intends to perform a number of repetitions and the user would like resistance to vary from repetition to repetition. In one example, user input may be provided at the time the user begins to use system 10. In another example user input may be preprogrammed into system 10 and stored. In such an example, the user may have a profile that the user could access and select such preprogrammed input for use in a workout.

Referring further to FIG. 1B and FIG. 4, in one example, controller 20 determines whether or not a user's input corresponds to an operational mode. An operational mode may comprise a predetermined mode of operation. For example, in the case of a Pilates reformer, the user may want to slide the carriage 12 freely. Accordingly, the operational mode would be to instruct motor 26 to turn loop drive such that carriage 12 would move freely in whatever direction the user moves it. In another example, the operation mode may be a predetermined resistance program in which case the controller 20 would instruct motor to operate in accordance with the resistance program. In another example, the operational mode may be to provide straight resistance. For example, the user could request 100 lbs. of resistance in which case the controller 20 would instruct motor 26 to rotate in a direction and at an amount of torque equal to 100 lbs. of resistance. In another example, the operational mode may be an isometric mode in which user would specify that it does not want carriage to move. Accordingly, controller 20 would operate motor 26 so that it remained fixed.

Referring further FIG. 1B and FIG. 5, in step 505, if it is determined that the user has selected an operation mode, then in step 507, the system 10 runs the operational mode. If in step 505, it is determined that the user has not selected an operational mode, then in step 509, system 10 may suggest an operational mode or enter into a default operational mode. System may provide output to user through input output system 406 describe in connection with FIG. 4.

The invention claimed is:

1. A system for providing variable resistance in an exercise machine, comprising:

a motor;

at least one loop drive attached to the motor, wherein the loop drive has an axis of rotation and is configured such that the motor is configured to turn the loop drive in a first direction and a second direction around the axis of rotation, a carriage, coupled to the loop drive, wherein the carriage includes an inner structure and an outer structure that move relative to each other and further wherein the carriage moves in a first direction when the loop drive is turned in the first direction and a second direction when the loop drive is turned in a second direction;

at least one sensor attached to the carriage, wherein the at least one sensor is configured to detect movement between the inner structure and outer structure; and a processor and a memory coupled with the processor, the memory comprising executable instructions that when executed by the processor cause the processor to effectuate operations comprising:

receiving information from the sensor indicative of the movement between the inner structure and the outer structure;

determining an external force on the carriage through measurement of the movement; and calculating a responsive movement of the carriage in response to the external force; and instructing the motor to turn the loop drive to apply the responsive movement.

2. The system of claim 1, further comprising a user interface coupled to the processor that allows a user of the exercise machine to identify resistance that the user would like the controller to apply over a range of an exercise movement.

3. The system of claim 2, wherein utilizing the information comprises determining a rotation of the motor such that it moves the carriage in a manner corresponding to the resistance that the user would like the controller to apply over the range of the exercise movement.

4. The system of claim 3, wherein the motor moves the carriage such that the resistance varies over the range of the exercise movement.

5. The system of claim 1, wherein the outer structure is connected to the inner structure by at least one connector that allows the outer structure to move relative to the inner structure in a direction along a line of movement of the loop drive.

6. The system of claim 5, wherein the at least one sensor comprises a slide potentiometer, wherein the slide potentiometer is attached to the inner structure and the outer structure; wherein the slide potentiometer detects movement of the inner structure and the outer structure relative to each other along the line of movement.

7. The system of claim 1, wherein the carriage includes an interface that allows the system to be attached to an actuator of the exercise machine, wherein the actuator is employed by a user to perform a resistance exercise.

8. The system of claim 7, wherein the exercise machine is a Pilates reformer machine and the actuator is a platform of the Pilates reformer machine.

9. The system of claim 7, wherein the exercise machine is a Pilates reformer machine and the actuator is a pulley on a Pilates reformer machine.

10. The system of claim 1, wherein the inner structure is moveably coupled to the outer structure, and wherein the inner structure is connected to the loop drive.

11. The system of claim 1, wherein the operations comprise instructing the motor to turn the motor in the first direction during a negative phase of an exercise movement and to turn the motor in a second direction during a positive phase of an exercise movement.

12. The system of claim 1, wherein the loop drive comprises a belt drive.

13. The system of claim 1, wherein the loop drive comprises a chain drive.

* * * * *